US007335096B2

(12) United States Patent
Perez et al.

(10) Patent No.: US 7,335,096 B2
(45) Date of Patent: Feb. 26, 2008

(54) ADJUSTABLE PERGOLA

(75) Inventors: Haim Perez, Tel Mond (IL); Emanuel Razon, Ein Vered (IL)

(73) Assignee: Pas-Cal Building Products Ltd., Moshav Ein Vered (IL)

( * ) Notice: Subject to any disclaimer, the term of this patent is extended or adjusted under 35 U.S.C. 154(b) by 94 days.

(21) Appl. No.: 10/922,913

(22) Filed: Aug. 23, 2004

(65) Prior Publication Data

US 2006/0040607 A1 Feb. 23, 2006

(51) Int. Cl.
*F24F 7/00* (2006.01)
*E06B 7/086* (2006.01)

(52) U.S. Cl. ..... 454/358; 49/77.1

(58) Field of Classification Search ..... 454/202, 454/224, 204; 49/77.1, 80.1
See application file for complete search history.

(56) References Cited

U.S. PATENT DOCUMENTS 2,574,344 A * 11/1951 Miller ..... 49/77.1
4,268,995 A * 5/1981 Villa ..... 49/87.1
4,926,599 A 5/1990 Scholz
5,306,210 A 4/1994 Smit
6,061,962 A 5/2000 Sosa

FOREIGN PATENT DOCUMENTS

| | | |
|---|---|---|
| AU | 198433573 A1 | 1/1985 |
| EP | 1 103 670 | 5/2001 |
| FR | 2821641 | 9/2002 |

* cited by examiner

*Primary Examiner*—Steven McAllister
*Assistant Examiner*—Helena Kosanovic
(74) *Attorney, Agent, or Firm*—Pearl Cohen Zedek Latzer, LLP

(57) ABSTRACT

A louver type roof structure includes a plurality of elongated parallel slats mounted on slat hinges pivotally supported on carrier beams transverse to the slats. The slats are pivotable between a closed position in which their longitudinal adjacent edges overlap each other, and an open position in which the slats are spaced apart. The slat hinges are mounted to the slats at their lower surface and allow pivoting of the slats between the closed position and an extreme open position by an angle of at least 90°, preferably 110°. The pivoting axis of the slat hinge is disposed substantially under the longitudinal edge of the slat which is overlapped by the adjacent slat. The roof structure may comprise a border slat adapted to be displaced when urged by an adjacent slat when the latter pivots towards its extreme open position.

10 Claims, 5 Drawing Sheets

ADJUSTABLE PERGOLA

FIELD OF THE INVENTION

This invention relates to louver-type pergolas/roofs, in particular pergolas built of rotatable slats supported in multiple hinges distributed along the length of the slat.

BACKGROUND OF THE INVENTION

U.S. Pat. No. 5,306,210 discloses a louver type roof structure including a plurality of parallel slats 10 mounted on hinges 11 which in turn are mounted on carrier beams 12 (FIG. 1). Each hinge comprises a base lever 16 and a body 14-15 with a free lever 18, rotatably connected to each other. The hinges are mounted to the carrier beams 12 by the base lever securable to the carrier beam in a selected position. The slats have characteristic profile with an upturn 4 and channel 2 at one edge, a downturn 3 and channel 1 at the other edge, both channels being open towards the underside of the slat. The hinges are secured to the slats by snapping the hinge body ends 14 and 15 into the channels without penetrating the slat. The free levers 18 of the hinges are rotatably connected to a movable rod 22 such as to provide synchronous pivoting of the slats between a closed position in which the slats are disposed in a roughly coplanar orientation (indicated by broken lines), and an open position in which the slats are disposed in spaced apart generally parallel planes. In the open position, the louver roof provides access for the sunlight and air currents, while in the closed position the roof provides shade and/or protection against rainfall.

Pergolas of the same louver type are produced by Pas-Cal™ (FIG. 2, functionally similar parts have the same numbers as in FIG. 1). The hinge 11 in these pergolas however constitutes a single integral body 14-15 made of plastic, while the base lever 16 is integral with a carrying beam 24. The hinge has lugs (axles) 20 rotatably mounted directly in the carrying beams 24 which have a U-shaped cross-section allowing elastic opening when the lugs are snapped in place.

The axes of hinge rotation in both above designs are disposed approximately under the middle of the slat profile. The slats are pivotable by 45-70° between the closed position and the extreme open position.

AU-B-33573/84 discloses a louver type roof structure comprising a support frame and a plurality of slats (louvers). The slats have box-like profile for rigidity as they are supported only at their ends. The axis of rotation is usually within the profile and the range of rotation may be close to 180° as there are no intermediate supports.

SUMMARY OF THE INVENTION

In accordance with the present invention, there is provided a louver type roof structure including a plurality of elongated parallel slats mounted on slat hinges pivotally supported on carrier beams transverse to the slats. The slats are pivotable between a closed position in which the slats lie roughly in one plane and their longitudinal adjacent edges overlap each other with respect to that plane, and an open position in which the slats are spaced apart. The slats have an upper surface facing the sky in the closed position and an opposite lower surface. The slat hinges are mounted to the slats at their lower surface and they allow pivoting of the slats between the closed position and an extreme open position by an angle of at least 90°, preferably 110°. The pivoting axes of the slats with such slat hinges are disposed substantially under one of two longitudinal edges of the slats when the slats are in the closed position and the plane is horizontal. Preferably, the pivoting axis is under the edge overlapped by an adjacent slat.

In one embodiment of the present invention, the roof structure further comprises a border slat disposed between two slats of said plurality, overlapping therewith when the two slats are in closed position. The border slat is adapted to be displaced when urged by a first of the two slats when it pivots towards its extreme open position. The border slat is spring-loaded so as to return to the overlapping position when the first slat returns to its closed position.

The border slat may slide under or over the second of the two slats when urged by the first slat. Preferably the border slat is carried by sliding hinges mounted to its lower surface and slidingly supported in the carrier beams. Preferably, the border slat is identical to at least one of the plurality of parallel slats and the sliding hinges are formed with same means for mounting to the slat as the slat hinges.

In another embodiment of the border slat, it may be adapted to rotate when urged by the first slat. Preferably, the border slat is carried by rotary hinges mounted to its lower surface and the rotary hinges are pivotally supported in the carrier beams.

The rotary hinges and the slat hinges preferably have pivoting levers, each of the rotary hinges being connected by its pivoting lever, via a movable rod, to the pivoting lever of the slat hinge of the second slat, for synchronous pivoting of the border slat and the second slat. The connection of the rotary hinge to the movable rod allows disconnection therefrom when the first slat urges the border slat and reconnection thereto when the first slat returns to its closed position.

The connection of the rotary hinge to the movable rod may comprise a lug associated with the pivoting lever of the rotary hinge and a socket associated with the movable rod and receiving the lug. The socket is open at one side thereof so as to allow the disconnection, while the lug is urged by a spring towards the socked so as to provide the reconnection.

Preferably, the rotary hinges are the same as at least some of the slat hinges and the border slat is the same as at least one of the plurality of parallel slats.

The border slat allows building the roof structure with two or more subsets of adjacent slats, slats of each subset being connected by their hinges for synchronous pivoting apart from the other subsets. A border slat is disposed between each two subsets so that each subset may be pivoted to the extreme position independently from the other subsets.

According to another aspect of the present invention, there is provided a slat hinge for use in the above-described louver type roof structure, allowing pivoting of the slats to extreme angles of at least 90°, preferably 110°. The hinge provides pivoting of the slats around an axis disposed substantially under one of the two longitudinal edges of the slats.

The slats used in the roof structure may have each two C-shaped channels along the edges thereof, the channels being open at the downside surface of the slat, and in such case the hinge has teeth for snapping into the two channels. Furthermore, the hinge has a spring-loaded element locking the teeth in at least one of the channels after the snapping.

The hinge is preferably made of one integral piece of material, for example, injection-molded plastic.

The adjustable pergola of the present invention provides for larger extreme angles of slats' opening bringing a number of advantages:

penetration of sunlight during longer hours of the day, especially through a pergola (roof) with considerable sloping angle;

dumping water or litter, e.g. dust, leaves, etc. down between the slats;

cleaning, e.g. brushing, washing, the upper surface of the slats from beneath.

Furthermore, the pergola of the present invention may be built with groups of slats, where each group is independently openable to the extreme angle of 90° and more.

BRIEF DESCRIPTION OF THE DRAWINGS

In order to understand the invention and to see how it may be carried out in practice, an embodiment will now be described, by way of non-limiting example only, with reference to the accompanying drawings, in which.

DETAILED DESCRIPTION OF THE EMBODIMENTS

Figure 1:
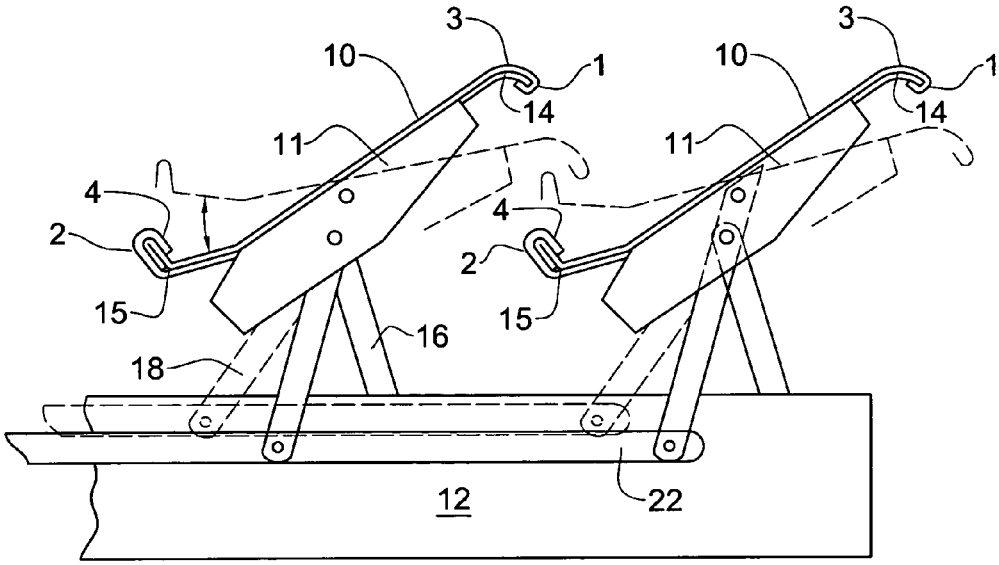
FIG. 1 (PRIOR ART)
FIG. 1 is schematic cross-section of a prior art pergola with adjustable slats.
Figure 2:
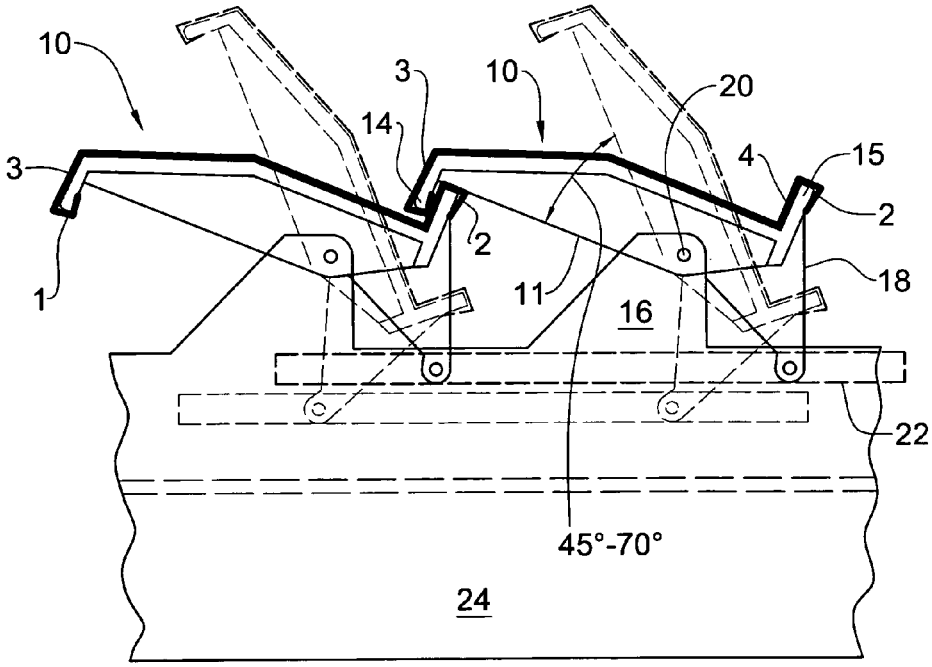
FIG. 2 (PRIOR ART)
FIG. 2 is schematic cross-section of another prior art pergola.
Figure 3:
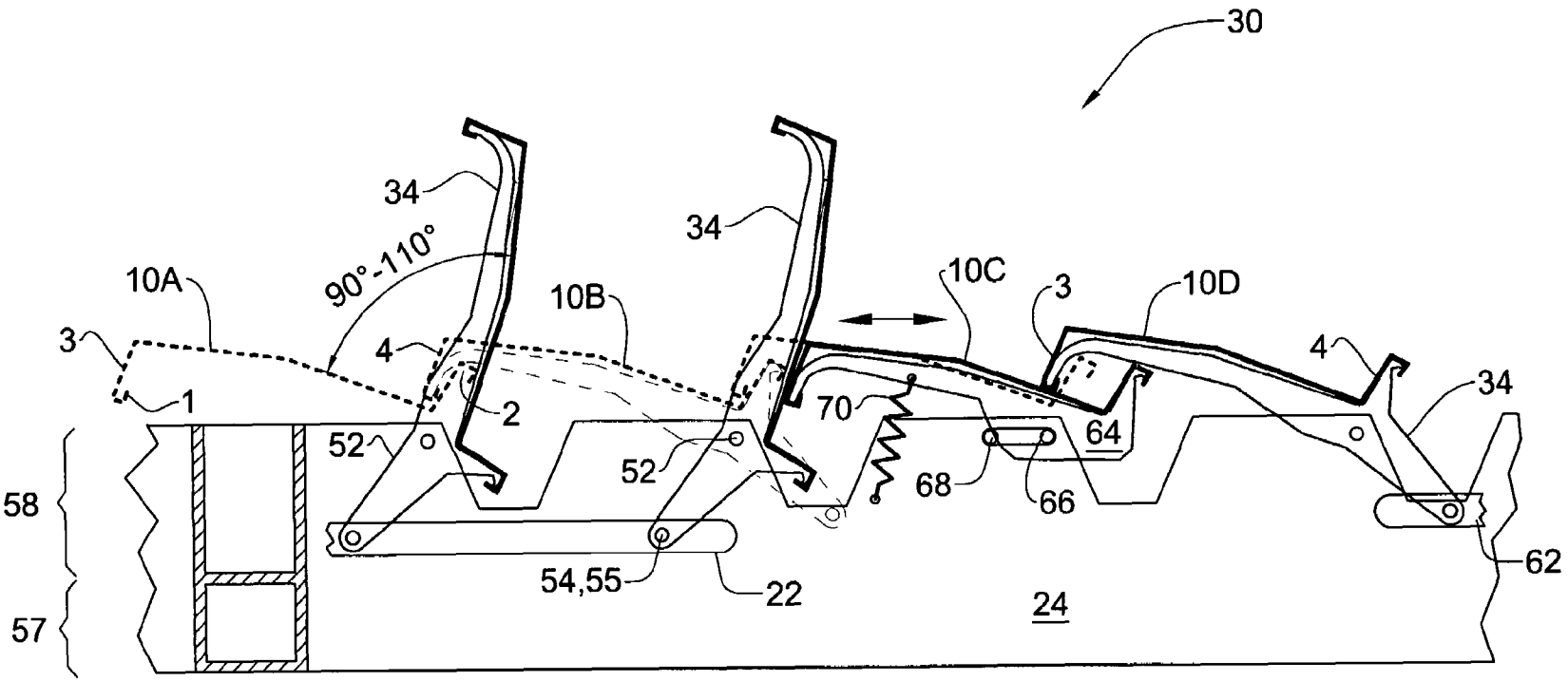
FIG. 3 is schematic cross-section of the adjustable pergola of the present invention, with sliding border slat.

With reference to FIG. 3, there is shown a side view of a pergola 30 of the louver type in accordance with the present invention. The pergola comprises a plurality of parallel slats 10 (10A, 10B, 10C, 10D, etc.) mounted on hinges 34 which are pivotally supported in carrier beams 24. The slats are connected to a movable rod 22 for synchronized pivoting.

The slats 10 have a generally Z-shaped profile, as described above, with an upturn 4 at one (higher) edge, and a downturn 3 at the other (lower) edge. The slats in their closed position are overlapping so that the "lower" edge of each "higher" slat is received in the upturned "higher" edge of the adjacent "lower" slat. The adjectives "higher" and "lower" refer to the common orientation of the pergola where the beams 24 are inclined such that the upturned edge 4 of the slat is higher than the downturned edge 3 so as to provide run-off of rain water down the pergola without accumulation and leaking between slats.

The edges of the slat profile end in C-shaped channels 1 (at the "lower" edge) and 2 (at the "higher" edge), both channels being open towards the underside of the slat.

Figure 4:
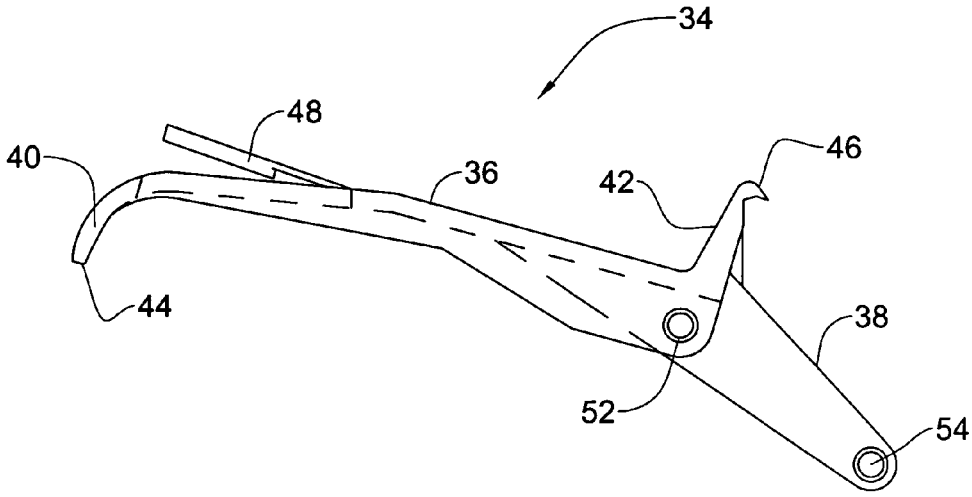
FIG. 4 is a side view of a hinge used in the adjustable pergola of FIG. 3.
Figure 5:
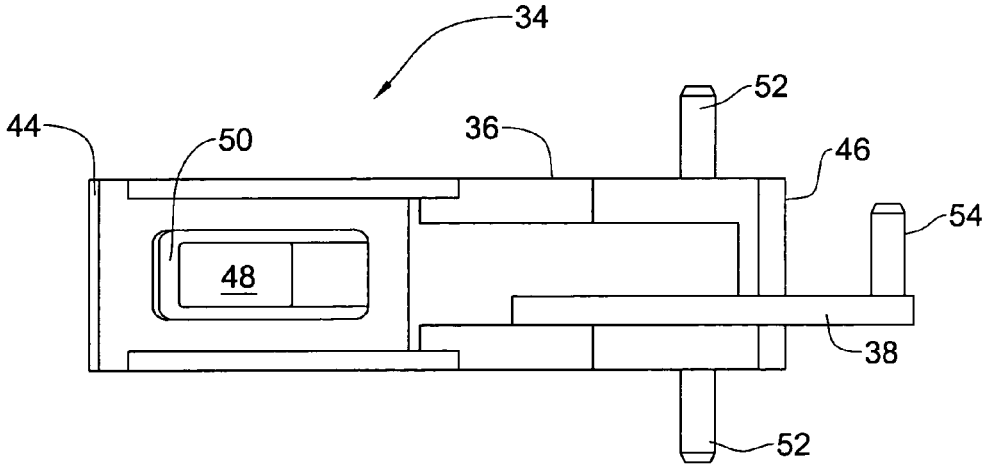
FIG. 5 is a bottom view of the hinge of FIG. 4.

With reference also to FIGS. 4 and 5, the hinge 34 comprises a body 36 and an integral lever 38. In side view (FIG. 4), the body 36 has also a Z-shape with a downturn 40 and upturn 42 corresponding to the slat Z-shaped profile. The downturn 40 ends in a tip 44 while the upturn 42 ends in a tooth 46. The tip 44 and the tooth 46 are designed so as to snap into the channels 1 and 2 of the slat profile (the tooth 46 being inserted first). The body 36 also has a flexible tongue 48 projecting above a window 50. When the slat profile 10 is being snapped over the hinge 34, the tongue 48 abuts the slat and elastically sinks into the window 50 until the tip 44 is received in the channel 1. Then the tongue 48 comes back as a lock urging the tip 44 into the channel 1 and preventing accidental detachment of the slat. This construction provides for very easy, fast and reliable assembly.

The hinge 34 further comprises two cylindrical lugs 52 for pivotal mounting to the carrier beam 24, and another cylindrical lug 54 at the end of the lever 38 for engagement to the movable rod 22.

The carrier beam 24 has a sectional profile 56 with a lower part 57 formed as a closed box and a U-shaped upper part 58. The closed-box profile imparts rigidity to the beam 24 while the arms of the U-shaped upper part allow elastic deformation so that the lugs 52 of the hinge 34 can be inserted in openings made in those arms.

The pergola 30 has two or more carrying beams 24 which may be supported on pillars, on a roof structure, embedded in a wall, etc. (not shown here). Each of the slats 10 is supported by a hinge 34 on each beam the slat crosses. The levers 38 of the hinges 34 mounted on one beam are rotatably engaged to a movable rod 22 by the lugs 54 inserted in openings 55. The rod 22 is engaged for longitudinal displacement to a driving mechanism (powered or manual) which may be fixed at various positions, thereby providing for simultaneous rotation and fixation of the slats 10 to various angular positions.

As seen in FIG. 3, the slats 10 in the pergola of the present invention may be pivoted to an extreme angle of about 90-110°. This is achieved by placing the pivoting axis (lugs 52) under the overlapped ("upper") edge of the slat profile. Such extreme angle provides for a number of advantages:

allows penetration of sunlight during longer hours of the day, especially through a pergola (roof) with considerable sloping angle;

allows dumping water, snow or litter, e.g. dust, leaves, etc. down between the slats;

allows cleaning, e.g. brushing or washing, the upper surface of the slats from beneath.

It is often convenient to open or close only part of the slats. For this purpose, groups of adjacent slats may be engaged to different movable rods which are moved by separate drives. For example, in FIG. 3 slats 10A and 10B are engaged to the movable rod 22 while the slat 10D is engaged to another movable rod 62. However, the opening angle of a "lower" group of slats is limited due to interference with an adjacent "higher" slat which is not opened. For example, as shown in FIG. 3, the slat 10B in open position is adjacent to and borders slat 10C and thus would interfere with the slat 10C in closed position.

Figure 6:
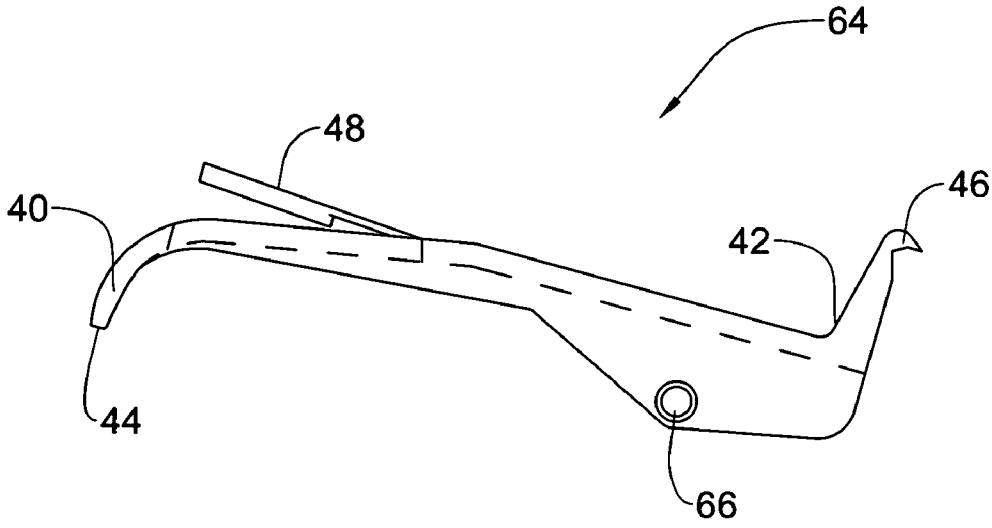
FIG. 6 is a side view of a sliding connector used in the adjustable pergola of FIG. 3.
Figure 7:
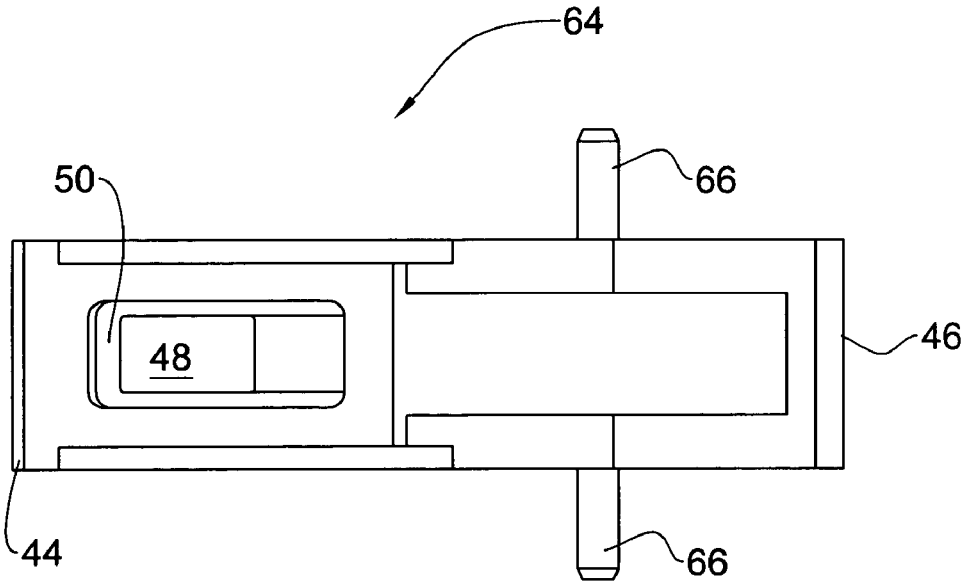
FIG. 7 is a bottom view of the sliding connector of FIG. 6.

In the pergola of the present invention, a "border" slat 10C is mounted on a special sliding connector 64 (see also FIGS. 6 and 7). The sliding connector 64 is shaped similar to the hinge body 36 (without the lever 38) and has all elements for snapping to a slat 10—tip 44, tooth 46 and the locking tongue 48. The connector has two lugs 66 which are received for sliding in elongated openings 68 made in the carrying beam 24. It will be appreciated that in operation, the slat 10B opening to the extreme angle will abut the "border" slat 10B and displace it. The "higher" edge of the slat 10 slides under the "lower" edge of the adjacent closed slat 10D. An expansion spring 70 is provided to keep the "border" slat 10C in closed position and to ensure its return when the slat 10B resumes its closed position. Thus two neighboring groups of slats may open independently to the extreme angle.

Figure 8:
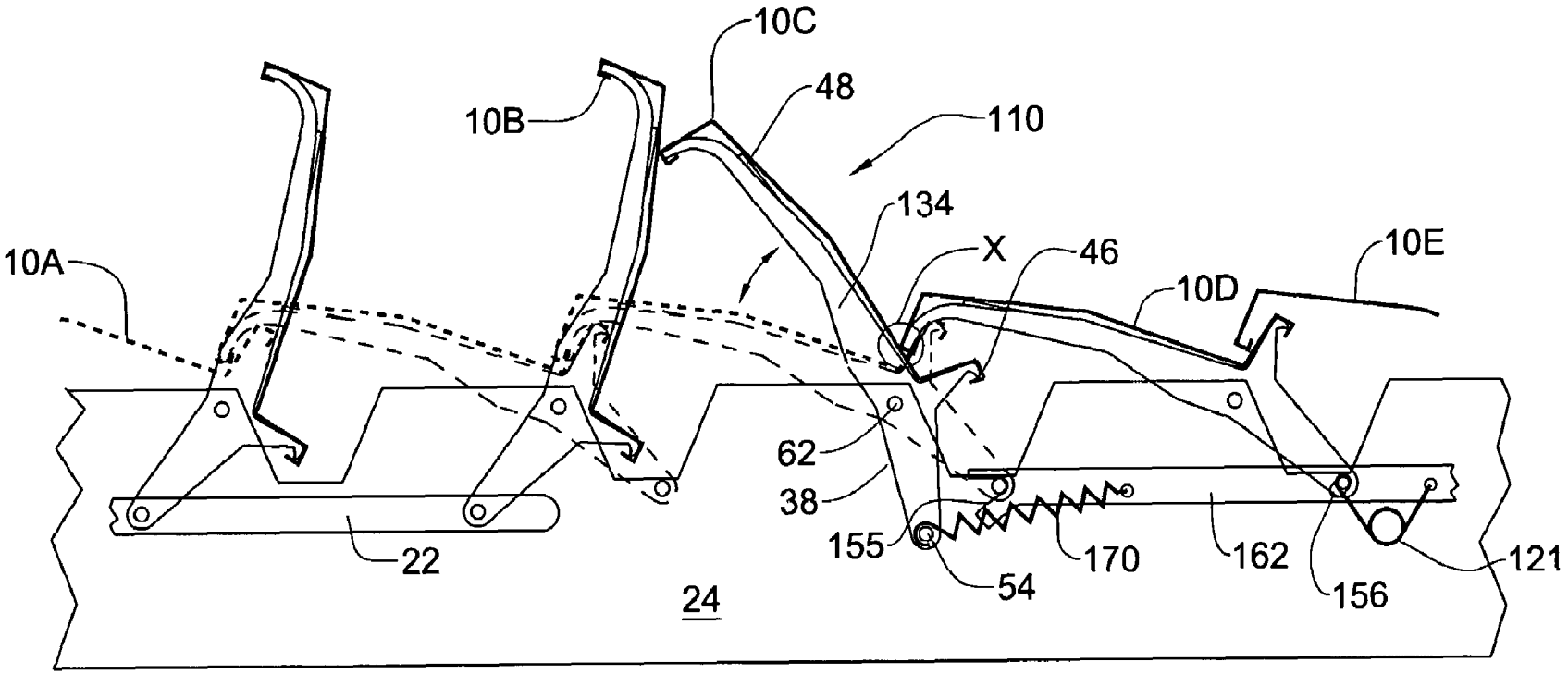
FIG. 8 is schematic cross-section of the pergola of FIG. 3, with rotary border slat.

With reference to FIG. 8, there is shown another embodiment of the "border" slat 110, mounted on a rotary hinge 134. The rotary hinge 134 is shaped similar to the regular hinge 34, with lugs 52 and 54, lever 38 and all elements for snapping to a slat 10—tip 44, tooth 46 and the locking tongue 48. The hinge 134 is pivotally supported on the lugs 52 inserted in openings in the carrying beam 24, also similar to the regular hinge 34. The hinge 134 is connected to a movable rod 162 for synchronous opening of the slat 110 with other regular slats 10D, 10E, etc. but the connection is slightly different.

The rod 162 has an open conical socket 155 instead of the regular opening 55. The lug 54 is held in the narrow bottom of the socket 155 by a pre-loaded spring 170. In this position of the lug 54, the slat 110 may be pivoted by the movable rod 162 together with the regular slats 10D, 10E, etc.

If the adjacent slat 10C is opened, it urges the border slat 110 to rotate and the lug 54 leaves the socket 155 overcoming the spring 170. Thus, the displacement of the border slat 110 allows the adjacent slat 10C to reach the extreme open position.

The slats 10 and 110 as well as the hinges 34 and 134 may be designed identical by carefully selecting the geometry of the slat profile. This would be the most effective solution from production and economical point of view.

If standardized profiles are used, there may be some interference between the displaced border slat 110 and its neighbor 10D, as shown in the zone X. In such case, the next slat 10D may be given some freedom of rotation by making the corresponding opening 156 in the movable rod 162 slightly elongated and spring-loading the corresponding lug 54 by another spring 171. It will be appreciated that the elongation of the opening 156 may be rather small and will not require wider movable rod 162.

Although a description of specific embodiments has been presented, it is contemplated that various changes could be made without deviating from the scope of the present invention as defined by the claims.

The invention claimed is:

1. A louver type roof structure including a plurality of elongated parallel slats mounted on slat hinges pivotally supported on carrier beams transverse to said slats so that said slats are pivotable between a closed position in which said slats lie roughly in one plane and their longitudinal adjacent edges overlap each other with respect to said plane, and an open position in which said slats are spaced apart, said slats having an upper surface facing the sky in said closed position, and an opposite lower surface, said slat hinges being mounted to said slats at said lower surface, wherein said slat hinges allow pivoting of said slats between said closed position and an extreme open position by an angle of at least 90°, said plurality of elongated parallel slats arranged in one or more subsets of slats, the slats of each subset being simultaneously operable, said roof structure further comprising a border slat disposed adjacent an end slat of said one or more subsets of slats, the border slat mounted to a linearly sliding hinge having a linearly sliding pivot point, said linearly sliding hinge and border slat, linearly slideable with relation to said one or more subset of slats in a confined track between two positions so as to allow the border slat to retract from a first position to a second position, away from the end slat, when the end slat is turned from a closed substantially horizontal position to an open upright position, allowing the end slat to reach the extreme open position the linearly sliding hinge being coupled to a spring that urges the linearly sliding hinge to the first position when not forced to retract by the end slat.

2. The roof structure of claim 1, wherein said angle is at least 110°.

3. The roof structure of claim 1, wherein the slats of each of said one or more subsets of slats being simultaneously operable by a connecting rod.

4. The roof structure of claim 3, wherein said connecting rod is coupled to a pivoting lever provided on each of the slats of each of said one or more subsets of slats.

5. The roof structure of claim 1, wherein said slat hinges are made each of one integral piece of material.

6. The roof structure of claim 5, wherein said slat hinges are made of injection-molded plastic.

7. The roof structure of claim 1, said border slat being spring-loaded by a spring element so as to return to an overlapping position when an adjacent slat returns to its closed position.

8. The roof structure of claim 1, wherein said linearly sliding hinges are slidingly supported in said carrier beams.

9. The roof structure of claim 1 wherein said border slat is the same as at least one of said plurality of parallel slats.

10. The roof structure of claim 4, wherein the pivoting lever and the connecting rod are disconnectable.

* * * * *